US007850025B2

(12) United States Patent
Neupert et al.

(10) Patent No.: US 7,850,025 B2
(45) Date of Patent: Dec. 14, 2010

(54) METHOD FOR CONTROLLING THE ORIENTATION OF A CRANE LOAD

(75) Inventors: Jörg Neupert, Korntal-Müchingen (DE); Oliver Sawodny, Stuttgart (DE); Klaus Schneider, Hergatz (DE)

(73) Assignee: Liebherr-Werk Nenzing GmbH, Nenzing (AT)

( * ) Notice: Subject to any disclaimer, the term of this patent is extended or adjusted under 35 U.S.C. 154(b) by 126 days.

(21) Appl. No.: 11/827,972

(22) Filed: Jul. 13, 2007

(65) Prior Publication Data

US 2008/0017601 A1 Jan. 24, 2008

(30) Foreign Application Priority Data

Jul. 18, 2006 (DE) ..... 10 2006 033 277

(51) Int. Cl.
*B66C 13/06* (2006.01)

(52) U.S. Cl. ..... 212/275; 212/270

(58) Field of Classification Search ..... 212/270, 212/275

See application file for complete search history.

(56) References Cited

U.S. PATENT DOCUMENTS

| | | | | |
|---|---|---|---|---|
| 1,899,266 | A | 2/1933 | Foster | |
| 4,979,265 | A | 12/1990 | Grass | |
| 5,089,972 | A * | 2/1992 | Nachman et al. | 700/218 |
| 6,241,462 | B1 * | 6/2001 | Wannasuphoprasit et al. | 414/800 |
| 6,496,765 | B1 * | 12/2002 | Robinett et al. | 701/50 |
| 6,826,452 | B1 * | 11/2004 | Holland et al. | 700/245 |
| 7,426,423 | B2 * | 9/2008 | Schneider et al. | 700/213 |

FOREIGN PATENT DOCUMENTS

| | | |
|---|---|---|
| DE | 19907989 | 10/1999 |
| DE | 19826695 | 12/1999 |
| DE | 29921246 | 2/2000 |
| DE | 10029579 | 1/2002 |
| DE | 10064182 | 5/2002 |
| DE | 10159140 | 7/2002 |
| DE | 10324692 | 1/2005 |
| EP | 1366868 | 12/2003 |
| JP | 62006848 | 1/1987 |
| WO | 01/60194 | 8/2001 |

OTHER PUBLICATIONS

European Patent Office, International Search Report of EP04003288, Oct. 17, 2008, 2 pages.
ISA European Patent Office Search Report of EP 07007445, Mar. 30, 2009, Germany.

* cited by examiner

*Primary Examiner*—Thomas J. Brahan
(74) *Attorney, Agent, or Firm*—Alleman Hall McCoy Russell & Tuttle LLP

(57) ABSTRACT

A method for controlling the orientation of a crane load is described, wherein a manipulator 416 for manipulating the load is connected by a rotator unit to a hook suspended on ropes 410 and the rotational angle $\phi_L$ of the load is controlled by a control unit using the moment of inertia $J_L$ of the load as most important parameter. The control unit is an adaptive control unit wherein the moment of inertia $J_L$ of the load is identified during operation of the crane based on data obtained by measuring the state of the system.

24 Claims, 8 Drawing Sheets

METHOD FOR CONTROLLING THE ORIENTATION OF A CRANE LOAD

CROSS REFERENCE TO RELATED APPLICATION

This application claims priority to German Patent Application Serial No. DE10 2006 033 277.6, filed Jul. 18, 2006, which is hereby incorporated by reference in its entirety for all purposes.

FIELD

The present disclosure relates to a method for controlling the orientation of a crane load, wherein a manipulator 416 for manipulating the load is connected by a rotator unit to a hook suspended on ropes 410 and the rotational angle $\phi_L$ of the load is controlled by a control unit using the moment of inertia $J_L$ of the load as most important parameter.

BACKGROUND AND SUMMARY

In DE 100 64 182 and DE 103 24 692, the entire content of which is incorporated into the present application by reference, control and automation concepts for harbour mobile cranes are disclosed. In these rotary boom cranes the manipulator 416 for grabbing the load is suspended on ropes 410 and positioning of the manipulator for grabbing containers causes spherical swaying movements. The control concepts use trajectory tracking control to control the movement of the load and to automatically avoid sway, thereby increasing the effectiveness of the cargo handling process.

For such control systems a method for controlling the orientation of the crane load is known from DE 100 29 579, the entire content of which is incorporated into the present application by a reference. There, the hook suspended on ropes has a rotator unit containing a hydraulic drive 412, such that the manipulator 416 for grabbing containers can be rotated around a vertical axis. Thereby it is possible to vary the orientation of the crane loads. If the crane operator or the automatic control gives a signal to rotate the manipulator and thereby the load around the vertical axis, the hydraulic motors of the rotator unit are activated and a resulting flow rate causes a torque. As the hook is suspended on ropes, the torque would result in a torsional oscillation of the manipulator and the load. To position the load at a specific angle $\phi_L$, this torsional oscillation has to be compensated.

The known control method uses a dynamic model of the system based on the equations of motion of a physical model of the crane, the known anti-torsional oscillation control 212 consisting of a trajectory planning module 310 and a trajectory tracking module. The trajectory planning module calculates the trajectory of the variables describing the state of the system and produces a reference function. The trajectory tracking control can be divided into disturbance rejection, feed forward control and the state feed back control. The parameters used by the control unit are the mass of the load and most importantly, the moment of inertia of the load.

However, the distribution of mass inside the load, e.g. a container, is unknown and therefore the moment of inertia of the load is not known, either. The moment of inertia $J_L$ of the load therefore has to be estimated. In the known control system, this is done by assuming a homogenous mass distribution inside the load and calculating an estimated moment of inertia $J_L$ of the load from the mass of the container 418 and the known dimensions of the container only.

However, the distribution of load inside a container is usually far from homogenous, such that the estimated value of the load $J_L$ is only a very imprecise approximation. As the control unit uses the moment of inertia $J_L$ of the load as a parameter for controlling the orientation of the crane load, the difference between the true value of the moment of inertia $J_L$ and the rough estimate leads to an imprecision in the control of the orientation of the load.

The aim of the present disclosure is therefore to provide a method for controlling the orientation of the crane load that has better precision.

This aim is achieved by a method for controlling the orientation of a crane load, wherein the control unit for controlling the rotational angle $\phi_L$ of the load is an adaptive control unit wherein the moment of inertia $J_L$ of the load is identified during operation of the crane based on data obtained by measuring the state of the system.

Thereby, the moment of inertia $J_L$ of the load can be identified, leading to a better precision for this important parameter used by the control unit to control the orientation of the crane load. The control unit is adapted during operation of the crane by using as a parameter a corrected value of the moment of inertia $J_L$ identified during operation of the crane based on the data obtained by measuring the state of the system. Therefore, the control unit does not use a fixed value estimated once and for all, but a value adapted using further information gained during the operation of the crane.

In the method for controlling the rotation of the crane of the present disclosure, the rotational angle $\phi_L$ of the load is advantageously controlled using an adaptive trajectory tracking control. This allows an effective control of the movements of the crane load. For example, a feed forward control can be used to calculate the trajectories of the system variables based on forward integration of the equations of motion of the system and a state feed back control can use data obtained by measuring the state of the system.

In the method for controlling the rotation of a crane load of the present disclosure, advantageously a dynamic model of the system is used to calculate data describing the state of the system, i.e. the trajectories of the system variables. These data can then form the basis for controlling the rotation of the crane load, the dynamic model of the system allowing an accurate description of the system and therefore a precise control of the orientation of the crane load.

In a further development of the method for controlling the orientation of a crane load of the present disclosure, the difference $\phi_C$ between the rotational angle $\phi_L$ of the load and the rotational angle $\phi_H$ of the hook can be varied by the rotator unit. This is advantageously done by using a hydraulic motor for the rotator unit, such that torque can be applied by the rotator unit. This makes it possible to rotate the manipulator and thereby the load about a vertical axis, thereby allowing an orientation of the load in any desired direction.

In a further development of the method for controlling the orientation of a crane load of the present disclosure, torsional oscillations are avoided by an anti-torsional oscillation unit using the data calculated by the dynamic model. This anti-torsional oscillation unit uses the data calculated by the dynamic model to control the rotator unit such that oscillations of the load are avoided. Thereby, the anti-torsional oscillation unit 212 can generate control signals that counteract possible oscillations of the load predicted by the dynamical model. If a hydraulic motor is used for the rotator, the anti-torsional oscillation unit can generate signals for activating the hydraulic motor, thereby applying torque generated by the resulting flow rate.

In a further development of the method for controlling the orientation of a crane load of the present disclosure, the difference $\phi_C$ between the rotational angle $\phi_L$ of the load and the rotational angle $\phi_H$ of the hook is measured by an encoder 414 connected to the rotator unit 318. This encoder makes it possible to exactly measure the difference $\phi_C$, and thereby helps to control the orientation of the load.

In a further development of the method for controlling the orientation of a crane load of the present disclosure, the movements of a cardanic element guided by the rope are measured to obtain data by which the rotational angle $\phi_H$ of the hook and/or the rotational angle $\phi_L$ of the load can be determined. The cardanic element preferably is connected to the boom head of the crane by a cardanic joint and follows the movements of the rope, on which it is guided by rollers. By measuring the movements of the cardanic element, the movements of the rope can be determined. As the hook is usually suspended on a plurality of ropes, preferably at least two cardanic elements are provided in order to determine the movements of at least two of these ropes. The rotational angle $\phi_H$ of the hook suspended on the ropes and/or the rotational angle $\phi_L$ of the load can then be determined from the data obtained from measuring the movements of the cardanic elements.

In a further development of the method for controlling the orientation of a crane load of the present disclosure, a gyroscope is used to obtain data by which the rotational angle $\phi_H$ of the hook and/or the rotational angle $\phi_L$ of the load can be determined. Using a gyroscope is a particularly effective way of obtaining such data with sufficient precision. The gyroscope can be mounted in different places on the crane. If cardanic elements are used, the gyroscope can be mounted on the cardanic elements to measure their movements, but it is also possible to mount the gyroscope directly on the hook or the manipulator.

In a further development of the method for controlling the orientation of a crane load of the present disclosure, the change $\dot{\phi}_H$ in the rotational angle $\phi_H$ of the hook and/or the changed in the rotational angle $\phi_L$ of the load is measured by a gyroscope. The gyroscope can either be mounted on the hook or the manipulator 20, but preferably on the hook. Gyroscopes can measure the angular velocities $\dot{\phi}_H$ and $\dot{\phi}_L$, which allows a determination of the rotational angles angle $\phi_H$ of the hook and the $\phi_L$. If $\dot{\phi}_H$ is measured by the gyroscope, $\phi_H$ can be determined by integration. The rotational angle $\phi_L$ of the load can then be calculated by using the difference $\phi_C$ between the rotational angle $\phi_L$ of the load and the rotational angle $\phi_H$ of the hook measured by the encoder 414. As the value of $\phi_H$ measured by the gyroscope will contain noise and an offset, straightforward integration would lead to an accumulation of these errors, leading to poor results in accuracy. Therefore, a disturbance observer 314 is advantageously used to compensate for offset. This allows a more robust estimation of the rotational angle $\phi_H$ from the angular velocity $\dot{\phi}_H$.

In a further development of the method for controlling the orientation of a crane load of the present disclosure, the dynamical model of the system is based on the equations of motion of a physical model of at least the ropes, the hook and the load. In such a physical model, the hook and the load suspended on the ropes form a torsional pendulum, whose equations of motion can be determined using e.g. the Lagrange formalism. This allows a realistic description of the system and therefore a precise trajectory planning 310 and control.

Advantageously, the moment of inertia $J_H$ of the hook and $J_{Sp}$ of the manipulator are used as parameters for the control of the rotational angle $\phi_L$ of the load. Even though the moment of inertia $J_H$ of the hook and $J_{Sp}$ of the manipulator are usually smaller than the moment of inertia $J_L$ of the load, they nevertheless contribute to the rotational behaviour of the system and should be accounted for in the calculations and the physical model.

In a further development of the method for controlling the orientation of a crane load of the present disclosure, during the operation of the crane a torque is applied to the load and/or the hook. The data obtained by measuring the state of the system while a torque is applied to the hook and/or the load will allow to estimate the moment of inertia $J_L$ of the load, e.g. by using an observer.

Advantageously, the data obtained by measuring the state of the system at least comprises the change $\dot{\phi}_H$ in the rotational angle $\phi_H$ of the hook and/or the changed, in the rotational angle $\phi_L$ of the load in reaction to the torque applied to the load and/or the hook. This data can then be used to estimate the moment of inertia $J_L$ of the load, e.g. by comparing data calculated by the dynamic model with the measured data.

In a further development of the method for controlling the orientation of a crane load of the present disclosure, a value of the moment of inertia $J_{L0}$ estimated on the basis of the mass and the dimensions of the load only is used as an initial value for $J_L$ and corrected values $J_{Lk}$ are determined in an iterative process in order to identify the moment of inertia $J_L$. This will give a rough estimate of the initial value for $J_L$ based on the data that are quickly available, while better estimates are determined during the operation of the crane based on the additional data obtained by measuring the state of the system.

In a further development of the method for controlling the orientation of a crane load of the present disclosure, during operation of the crane data describing the state of the system are calculated by the dynamical model based on a value $J_{L,k-1}$ of the moment of inertia $J_L$ and a corrected value $J_{Lk}$ of the moment of inertia $J_L$ is determined based on the calculated data and the data obtained by measuring the state of the system in order to identify the moment of inertia $J_L$. This allows a far better estimation of the moment of inertia $J_L$ than using the mass and dimensions of the load only.

The moment of inertia $J_L$ can advantageously be identified using an observer. This method of estimating the moment of inertia $J_L$ uses data calculated by the dynamic model and combines them with data obtained by measuring the state of the system to estimate the parameter $J_L$ of the dynamic model. Using an observer for determining variables of the system such as the rotational angle $\phi_H$ of the hook from the angular velocity $\dot{\phi}_H$ measured by the gyroscope had already been known. Here, however, a parameter of the model is determined using an observer, leading to an adaptive control.

As a parameter of the model is estimated by the observer, the problem becomes non-linear, such that advantageously the moment of inertia $J_L$ is identified using a non-linear observer. There are different possibilities for implementing a non-linear observer, especially for time-variant models, such as the high-gain approach or the extended Kalman Filter 316.

The last possibility offers a very robust system for quickly estimating parameters of the system, such that advantageously the moment of inertia $J_L$ is identified using an extended Kalman Filter.

In a further development of the method for controlling the orientation of a crane load of the present disclosure, a homogeneous distribution of mass inside the load is assumed for the estimation of an initial value $J_{L0}$ of the moment of inertia $J_L$ of the load. This allows a quick calculation that only needs the mass and dimensions of the load as an input.

In a further development of the method for controlling the orientation of a crane load of the present disclosure, noise in the data obtained by measurements is taken into account in the identification of the moment of inertia $J_L$. This will lead to more precision in the estimation of the moment of inertia $J_L$ which is based on the measured data and therefore influenced by noise in the measurements.

Advantageously, the noise in the data obtained by measurements is modelled by covariance matrices. This allows a quantitative description of the influence of the noise and can minimize the errors resulting from the noise.

These covariance matrices are advantageously determined experimentally. By testing the control system with different values for the covariance matrices, the best values for a quick and robust estimation of the moment of inertia $J_L$ can be determined and used for the observer.

The present disclosure further comprises a system for controlling the orientation of a crane load using any one of the methods described above. Such a control system comprises a control unit for controlling the rotational angle $\phi_L$ of the load. Advantageously, the control unit contains a trajectory planning unit 310 and a trajectory control unit, as well as an observer for estimating the moment of inertia $J_L$.

The present disclosure further comprises a crane, especially a boom crane, comprising a system for controlling the rotation of a crane load using any of the methods described above. Such a crane comprises a hook suspended on ropes, a rotator unit and a manipulator. Advantageously, the crane will also comprise an anti-sway-control system 210 that interacts with the system for controlling the rotation of a crane. If the crane is a boom crane, it comprises a boom that can be pivoted up and down around a horizontal axis and rotated around a vertical axis by a tower. Additionally, the length of the rope can be varied.

BRIEF DESCRIPTION OF THE FIGURES

The present disclosure will now be described in more detail based on the following drawings. Therein

DETAILED DESCRIPTION

Figure 1A:
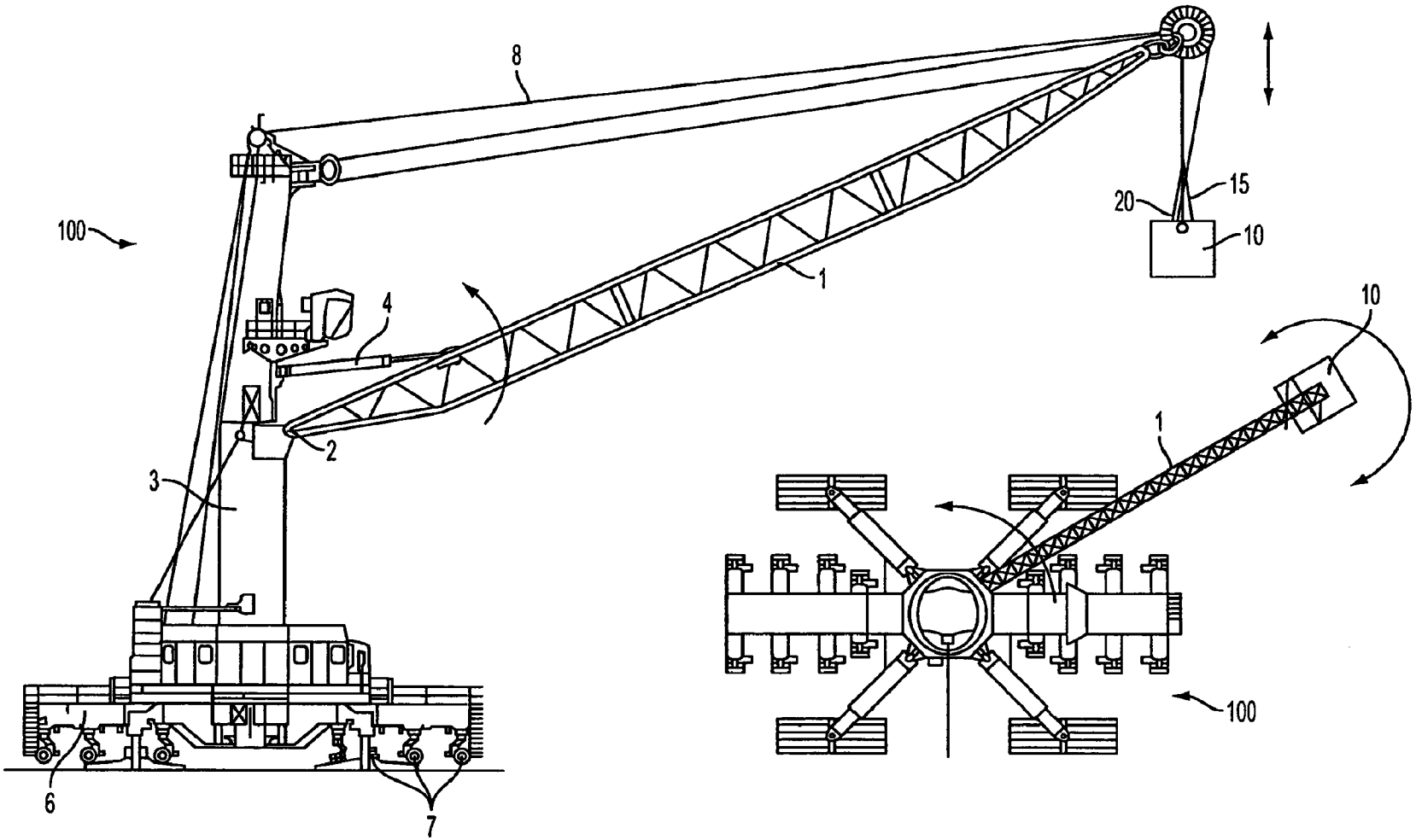
FIG. 1*a* shows a side view and a top view of a mobile harbour crane.

Boom cranes are often used to handle cargo transshipment processes in harbors. Such a mobile harbor crane is shown in FIG. 1*a*. The crane has a load capacity of up to 140 t and a rope length of up to 80 m. It comprises a boom 1 that can be pivoted up and down around a horizontal axis formed by the hinge axis 2 with which it is attached to a tower 3. The tower 3 can be rotated around a vertical axis, thereby also rotating the boom 3 with it. The tower 3 is mounted on a base 6 mounted on wheels 7. The length of the rope 8 can be varied by winches. The load 10 can be grabbed by a manipulator or spreader 20, that can be rotated by a rotator unit 15 mounted in a hook suspended on the rope 8. The load 10 is rotated either by rotating the tower and thereby the whole crane, or by using the rotator unit 15. In practise, both rotations will have to be used simultaneously to orient the load in a desired position.

For simplicity, only the rotation of a load suspended on an otherwise stationary crane will be discussed here. However, the control concept of the present disclosure can be easily integrated in a control concept for the whole crane.

Especially for container transshipment the anti-sway control already known from DE 100 64 182 and DE 103 24 692 was extended by a control and automation concept for the container orientation to prevent unwanted oscillation of the load based on the dynamic model of the system. This control concept for the container orientation is disclosed in DE 100 29 579, where the moment of inertia of the crane load is estimated based on the assumption that the mass distribution inside the container is homogeneous.

As the spreader/rotator system can be considered as a flexible link robot with a slow dynamic behavior, an adaptive and model based method is applied to control the manipulator. In order to improve the performance of this control concept, the parameters of the dynamic model of the system, and especially the moment of inertia of the load, must be known as precisely as possible. The present disclosure discloses an identification method to improve these control and automation concepts of a harbor mobile crane described in DE 10064182, DE 10324692 and DE 10029579 as well as in O. Sawodny, H. Aschemann, J. Kümpel, C. Tarin, K. Schneider, *Anti-Sway Contro for Boom Cranes*, American Control Conference, Anchorage USA, Proc. pp 244-249, 2002; 0. Sawodny, A. Hildebrandt, K. Schneider, *Control Design for the Rotation of Crane Loads for Boom Cranes*, International Conference on Robotics & Automation, Taipei Taiwan, Proc. pp 2182-2187, 2003 and J. Neupert, A. Hildebrandt, O. Sawodny, K. Schneider, *A Trajectory Planning Strategy for Large Serving Robots*, SICE Annual Conference, Okayama Japan, Proc. pp 2180-2185, 2005).

Due to the usually inhomogeneous distribution of the load inside the container, the moment of inertia estimated on the assumption that the distribution of load is homogeneous is only a very crude approximation of this parameter, leading to an imprecise control of the orientation of the container. Therefore, the present disclosure discloses a method to identify the moment of inertia of the load during operation of the crane based on data obtained by measuring the system. This way of estimating the moment of inertia of the load using an observer approach leads to better precision of the control method.

Figure 1B:
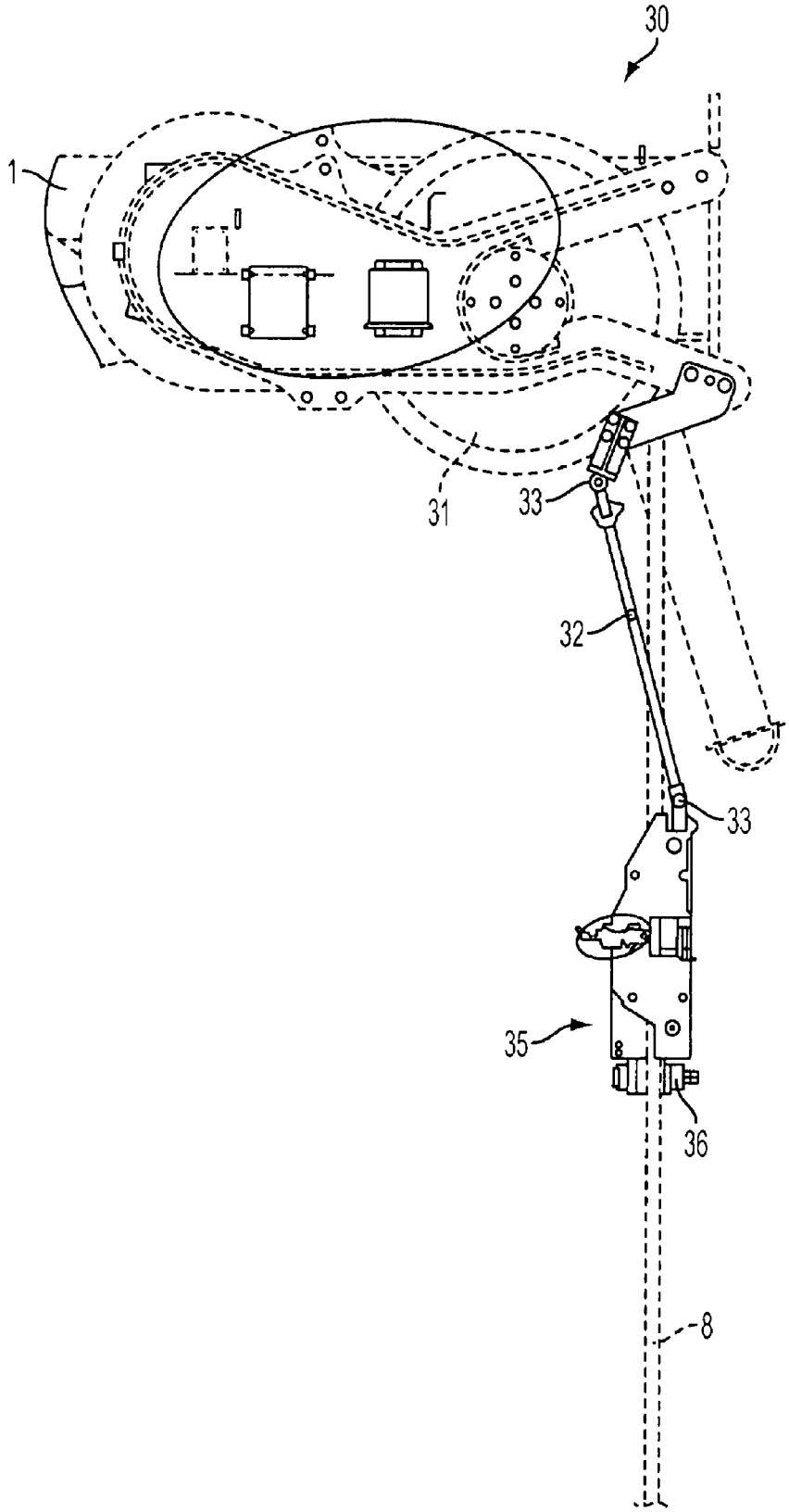
FIG. 1*b* shows a side view of the boom head of the mobile harbour crane with a cardanic element.

The data on which the identification of the moment of inertia of the load is based can be obtained by different methods. FIG. 1*b* shows a cardanic element 35 mounted to the boom head 30 of a boom 1 by cardanic joints 32 and 33 below the main roller 31. The cardanic element 35 has rollers 36 by which it is guided on the rope 8, such that it follows the movements of the rope 8. The cardanic joints 32 and 33 allow the cardanic element 35 to move freely around a horizontal and a vertical axis, but inhibit rotational movements. The movements of the cardanic element and therefore the movements of the rope can be measured. In this embodiment, two cardanic elements 35 are provided, which are guided on the two ropes the hook is suspended on. These data can then be used to calculate the torsion of the ropes and the angle $\phi_H$ of torsion of the hook. For this purpose, a gyroscope can be mounted on the cardanic elements. If no cardanic elements are used, a gyroscope can also be mounted directly on the hook or the manipulator in order to determine their rotational angles.

Different observer methods can be used in the present disclosure to identify the moment of inertia of the load during operation of the crane based on data obtained by measuring the system.

By applying the Least Square method to the measured input/output data, system parameters can be estimated. However, the standard least square method may be unsatisfactory when estimating time-varying parameters. To overcome this problem, exponential forgetting of the past data can be used. The forgetting factor can be chosen such that the resulting gain matrix maintains a constant trace. This approach can be further developed to the gain-adjusted-forgetting technique where the forgetting factor is continuously varied according to the norm of the gain matrix.

Another method of identification of the parameters of dynamic systems is the Extended Kalman Filter, which is used in the embodiment of the present disclosure. There are several advantages using this method which will be discussed later on.

Figure 2:
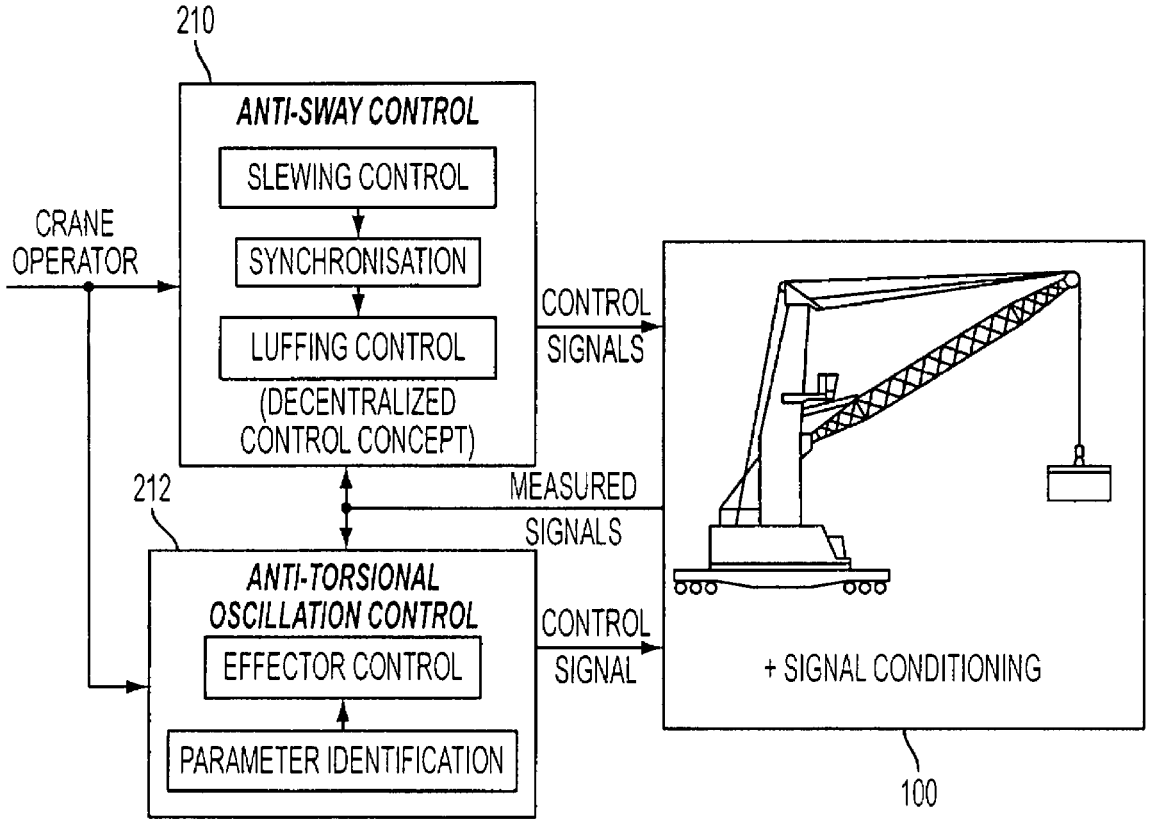
FIG. 2 shows the control structure of the mobile harbour crane.

FIG. 2 shows a known adaptive control concept in order to handle the load (container) orientation. This control concept, presented in (O. Sawodny, A. Hildebrandt, K. Schneider, *Control Design for the Rotation of Crane Loads for Boom Cranes*, International Conference on Robotics & Automation, Taipei Taiwan, Proc. pp 2182-2187, 2003) and also disclosed in DE 10029579, the content of which is incorporated into this application by reference, consists of a trajectory tracking control, a disturbance observer 314 and a state feedback control to reject torsional oscillations. In order to control the load orientation, the torsional angle is reconstructed out of the angular velocity which is measured by a gyroscope inside the hook. The angle between the hook and the container 418 is measured by an encoder 414. The load orientation is obtained by taking the sum of both angles. Due to the fact that all parts of the control concept are model based algorithms, they have to be adapted to parameter changes. Most of the parameters can be directly measured but the distribution of the load mass inside the container and hence the moment of inertia of the container is unknown. Since this parameter has a great influence on the dynamic behavior of the torsional oscillator and thus on the performance of the anti-oscillation control, it has to be identified on-line.

Dynamic Model for the Rope Suspended Manipulator

Figure 4:
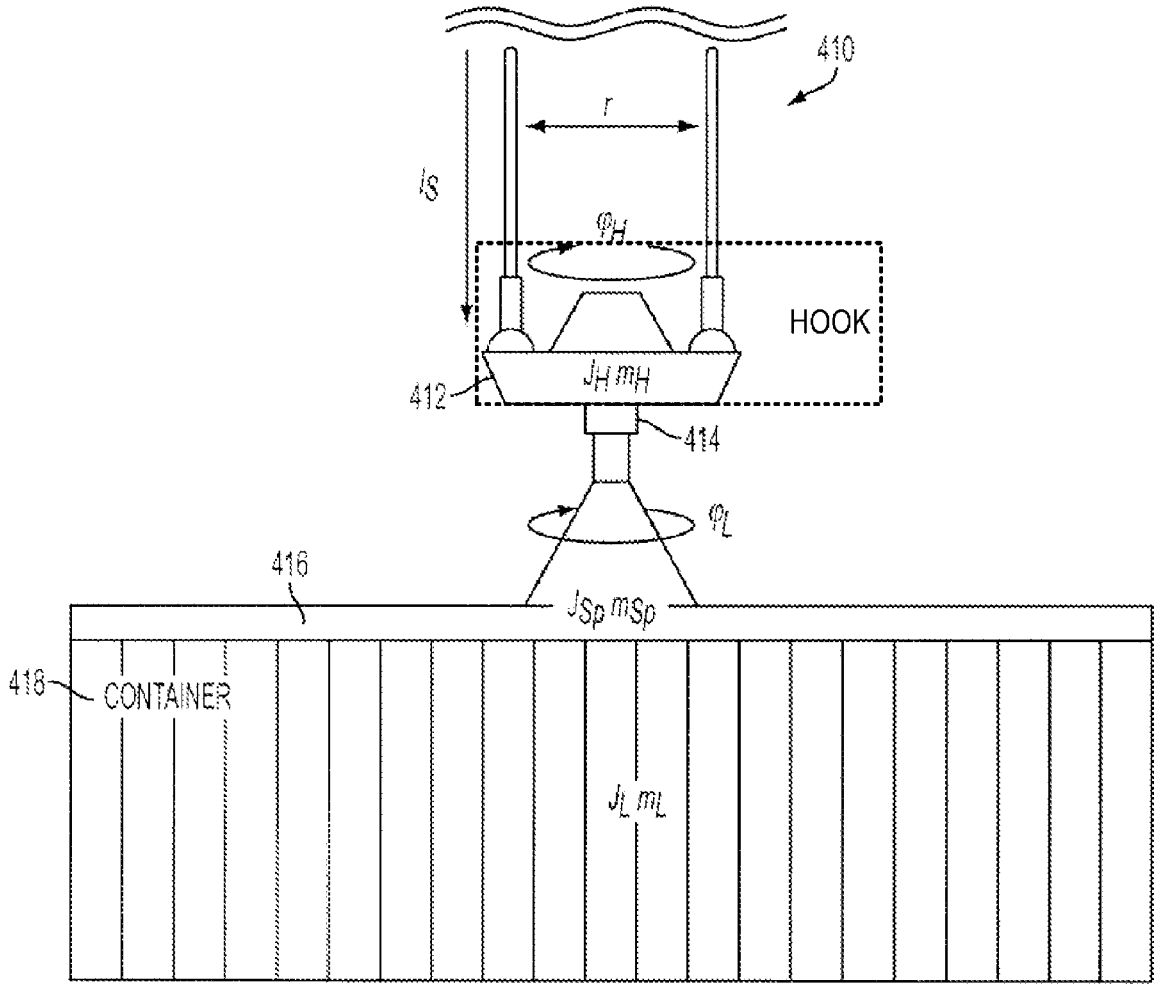
FIG. 4 shows a rope suspended rotator unit with manipulator and load and also schematically shows a hook.

To transship containers the boom crane is equipped with a special manipulator, the so called spreader. The manipulator can be rotated around the vertical axis by a rotator unit containing a hydraulic drive. As shown in FIG. 4 this unit is installed in the hook.

The hook is fixed on two ropes, whereas r and $l_S$ denote the effective distance of the two parallel ropes and the rope length, respectively. The system consists of three expanded bodies. The load (container) characterized by the moment of inertia $J_L$ and the mass $m_L$, the manipulator (container spreader) (416) and the hook. $J_{Sp}$ and $J_H$ indicate the moment of inertia of the spreader and the hook, $m_{Sp}$ and $m_H$ indicate the mass of the two bodies, respectively. The rotational angle of the spreader with load is denoted as $\phi_L$. The second angle $\phi_H$ indicates the angle of torsion.

To derive the equations of motion of the considered mechanical system the Lagrange formulation is utilized (according to L. Sciavicco, B. Siciliano, *Modelling and Control of Robot Manipulators*, Springer-Verlag London, Great Britain, 2001).

$$\frac{d}{dt}\frac{\partial L}{\partial \dot{q}_1} - \frac{\partial L}{\partial q_i} = \xi_i \tag{1}$$

The Lagrangian L is defined as difference between the kinetic energy T and the potential energy U of the system.

$$L = T - U \tag{2}$$

With the assumption that hook, spreader and load (container) are summarized to one expanded body with the total moment of inertia $J_{total} = J_H + J_{Sp} + J_L$ the kinetic and potential energy are obtained as follows:

$$T = \frac{J_{total}}{2}\dot{\varphi}_H^2;\ U = \frac{c_T}{2}\varphi_H^2 \tag{3}$$

$c_T$ describes the linearized torsional stiffness of the two parallel ropes as a function of the parameters $m_{total} = m_H + m_{Sp} + m_L$ and $l_S$, (g is the gravitational constant):

$$c_T = \frac{m_{total} g r^2}{4 l_S} \tag{4}$$

Solving equation (1) with the resulting Lagrangian and the generalized coordinate $q = \phi_H$ leads to the dynamic model of the rotator unit with load.

$$J_{total}\ddot{\phi}_H + c_T\phi_H = \xi \tag{5}$$

The generalized force is the moment of the hydraulic motor and can be defined as $$\xi = -(J_{Sp} + J_L)\ddot{\phi}_C \tag{6}$$

where $\ddot{\phi}_C$ is the relative angular acceleration between the hook and the spreader ($\ddot{\phi}_C = \ddot{\phi}_L - \ddot{\phi}_H$).

For the identification method the continuous model (equations (5) and (6)) is transformed into a discrete state space model of the following form:

$$\underline{x}_{k+1} = \underline{\Phi}\underline{x}_k + \underline{H}u_k$$

$$\underline{y}_k = \underline{C}\underline{x}_k \tag{7}$$

The system matrices, the state vector and the input vector are given:

$$\underline{\Phi}(T) = \begin{bmatrix} \cos(aT) & \frac{1}{a}\sin(aT) \\ -a\sin(aT) & \cos(aT) \end{bmatrix} \tag{8}$$

$$\underline{H}(T) = \begin{bmatrix} \frac{J_{Sp} + J_L}{c_T}[\cos(aT) - 1] \\ -\frac{J_{Sp} + J_L}{aJ_{total}}\sin(aT) \end{bmatrix}$$

$$\underline{C} = [0\ 1]$$

$$\underline{x}_k = [\varphi_{Hk}\ \dot{\varphi}_{Hk}]^T;\ u_k = \ddot{\varphi}_{Ck}$$

with $$a = \sqrt{\frac{c_T}{J_{total}}}$$

and the sampling time T.

Identification of the Uncertain Parameter

For the given application case the moment of inertia of the container must be determined during crane operation in order to adapt the model based control concept. Due to this fact the identification algorithm for the moment of inertia has to be iterative so that a new parameter estimate is generated each time an exact measurement of input/output data is obtained. Quite a few system identification methods have been discussed in the past. One of the methods for on-line parameter identification is the Extended Kalman Filter.

In order to estimate the unknown moment of inertia of the container, the state vector $\underline{x}_k$ of the discrete state space model (equations (7) and (8)) is extended by the unknown parameter $J_L$ (C. K. Chui, G. Chen, *Kalman Filtering with Real-Time Application*, Springer-Verlag Berlin Heidelberg, Germany, 3rd Edition, 1999).

$$\underline{\tilde{x}}_k=[\phi_{Hk}\dot{\phi}_{Hk}J_{Lk}]^T \tag{9}$$

With this extension a nonlinear discrete model of the following form is resulting:

$$\underline{\tilde{x}}_{k+1}=\underline{f}(\underline{\tilde{x}}_k,u_k)+\underline{g}_k v_k \tag{10}$$

where $v_k$ is a zero-mean white Gaussian noise sequence in order to describe the real system more accurately. The system noise is characterized by the following covariance matrix $$\underline{Q}=E(v_k v_k^T) \tag{11}$$

The vector-valued functions $\underline{f}$ and $\underline{g}$ are given by:

$$\underline{f}(\underline{\tilde{x}}_k, u_k) = \begin{bmatrix} \underline{\Phi}(J_{Lk})\underline{x}_k + \underline{H}(J_{Lk})\underline{u}_k \\ J_{Lk} \end{bmatrix} \tag{12}$$

$$\underline{g}_k = \begin{bmatrix} \underline{H}(J_{Lk}) \\ 0 \end{bmatrix}$$

As discussed in section 1 the rotational angle of the hook $\phi_H$ can not be directly measured. It has to be reconstructed out of the angular velocity $\dot{\phi}_{Hgyro}$ which is measured by a gyroscope in the hook. Since the gyroscope signal is noisy, the measurement noise has to be taken into account, resulting in a system output that can be modeled as:

$$\tilde{y}_k=\underline{h}\underline{\tilde{x}}_k+w_k \tag{13}$$

where $$\underline{h}=[0\ 1\ 0] \tag{14}$$

and $w_k$ is a zero-mean white Gaussian noise with the following covariance matrix $$\underline{R}=E(w_k w_k^T) \tag{15}$$

In order to apply the Kalman Filter to the obtained nonlinear system it has to be linearized by using a linear Taylor approximation at the previous state estimate $\hat{\underline{x}}_k$:

$$\tilde{x}_{k+1} \approx \underline{f}(\hat{\tilde{x}}, u_k) + \underline{F}(\hat{\tilde{x}}, u_k)(\tilde{x}_k, -\hat{\tilde{x}}_k) + \underline{g}(\hat{J}_{Lk})v_k \tag{16}$$

where $\underline{F}$ is the Jacobian matrix of $\underline{f}$ with the following coefficients:

$$F_{ij} = \frac{\partial f_i(\underline{\tilde{x}}, u)}{\partial \tilde{x}_j} \tag{17}$$

Calculating the coefficients for i,j=1, . . . , 3 the Jacobian matrix is obtained as:

$$\underline{F} = \begin{bmatrix} \Phi(J_{Lk}) & \frac{\partial}{\partial J_{Lk}}(\Phi(J_{Lk})\underline{x}_k + H(J_{Lk})u_{Lk}) \\ 0 & 1 \end{bmatrix} \tag{18}$$

With the linearized model and the covariance matrices $\underline{Q}$ and $\underline{R}$, the optimal Kalman Filter algorithm can be derived in the following form (T. Iwasaki, T. Kataoka, *Application Of An Extended Kalman Filter To Parameter Identification Of An Induction Motor*, Industry Applications Society Annual Meeting, Vol 1, pp 248-253, 1989):

1. Step: The prediction of the states $[\phi_{Hk}\ \dot{\phi}_{Hk}]$ and the parameter $J_{Lk}$ is calculated from the input $u_k$ and the estimated undisturbed states $\hat{\underline{x}}_k$ $$\underline{x}^*_{k+1}=\underline{\Phi}(\hat{J}_{Lk})\hat{x}_k+\underline{H}(\hat{J}_{Lk})\underline{u}_k \tag{19}$$

2. Step: The covariance matrices of the prediction error $\underline{M}_{k+1}$ and the estimation error $\underline{P}_{k+1}$ and the Kalman gain matrix $\underline{K}_{k+1}$ are calculated ($\underline{1}$ is the identity matrix) using:

$$\underline{M}_{k+1}=\underline{F}(\hat{\tilde{x}}_k,u_k)\underline{P}_k\underline{F}(\hat{\tilde{x}}_k,u_k)^T+g(\hat{J}_{Lk})\underline{Q}\underline{g}(\hat{J}_{Lk})^T \tag{20}$$

$$\underline{K}_{k+1}=\underline{M}_{k+1}\underline{C}^T(\underline{C}\underline{M}_{k+1}\underline{C}^T+\underline{R})^{-1} \tag{21}$$

$$\underline{P}_{k+1}=(\underline{I}-\underline{K}_{k+1}\underline{C})\underline{M}_{k+1} \tag{22}$$

3. Step: The estimation of the state vector and the moment of inertia of the container are obtained by correcting the predicted values with the weighted difference between the measured and the predicted angular velocity of the hook.

$$\begin{bmatrix} \hat{\tilde{x}}_{k+1} \\ \hat{J}_{Lk+1} \end{bmatrix} = \begin{bmatrix} \hat{\tilde{x}}^*_{k+1} \\ \hat{J}_{Lk+1} \end{bmatrix} + \underline{K}_{k+1}\left(\dot{\varphi}_{Hgyro} - \begin{bmatrix} 0 \\ 1 \end{bmatrix}^T \underline{x}^*_{k+1}\right) \tag{23}$$

The described algorithm is executed every time a new measurement of input/output data is available (k=1, 2, . . . ). To initialize the Extended Kalman Filter a start impulse is generated at the moment a container is grabbed. The states $[\phi_H\ \dot{\phi}_H]$, observed by the disturbance observer, at this moment is the initial estimation $\hat{\underline{x}}_0$ for the filter algorithm. The starting value for the moment of inertia of the container $\hat{J}_{L0}$ can be obtained by assuming that the container has an evenly distributed mass. Since the length $l_{container}$ and the mass $m_L$ of the container can be measured and the width is constant ($b_{container}$=2.4 m), the moment of inertia can be calculated as follows:

$$\hat{J}_{L0} = \frac{m_L}{12}(l^2_{container} + b^2_{container}) \quad (24)$$

The initial covariance matrix for the estimation error $\underline{P}_0$ is used to tune the identification algorithm (see section 4).

Results

Simulation

Figure 5:
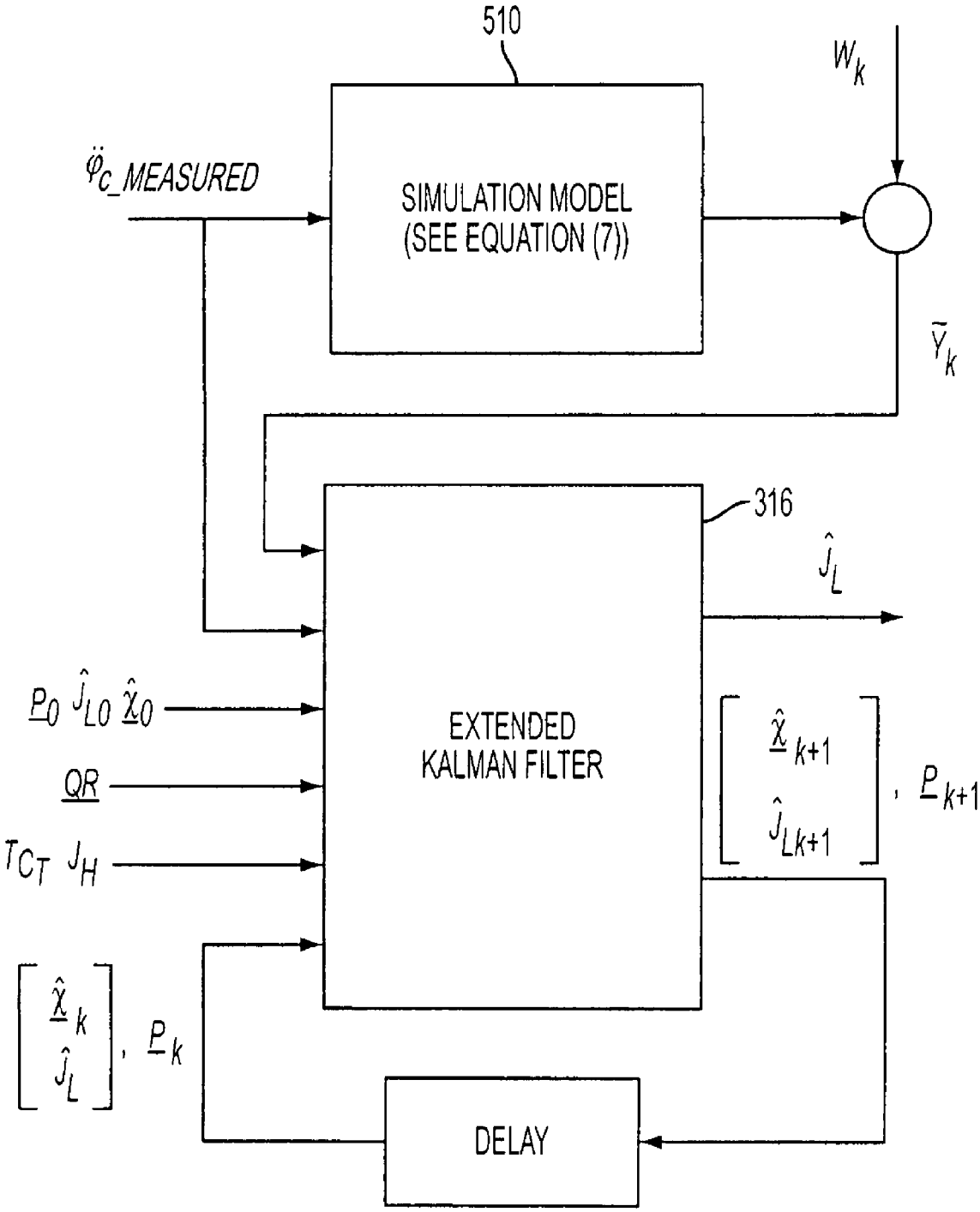
FIG. 5 shows the structure of a simulation environment.

In order to find good elements of the covariance matrix for the estimation error $\underline{P}_0$, the identification algorithm is implemented in a simulation environment. As shown in FIG. 5, the simulation model 510 is exited by the measurement signal $\ddot{\phi}_{c_measured}$ from the real system. Additionally a white noise $W_k$ sequence is added to the output signal of the simulation model.

The parameters and the initial conditions of the simulation are as follows:

$$\hat{J}_{L0}=0.8\cdot J_{Lmodel};\ J_{Lmodel}=36000\ \text{kgm}^2$$

$$\underline{x}_0=[0\ 0]^T;\ \underline{Q}=10^{-10};\ \underline{R}=10^{-6}$$

$$T=0.25\ \text{s};\ c_T=3750;\ J_H=940\ \text{kgm}^2 \quad (25)$$

Figure 6:
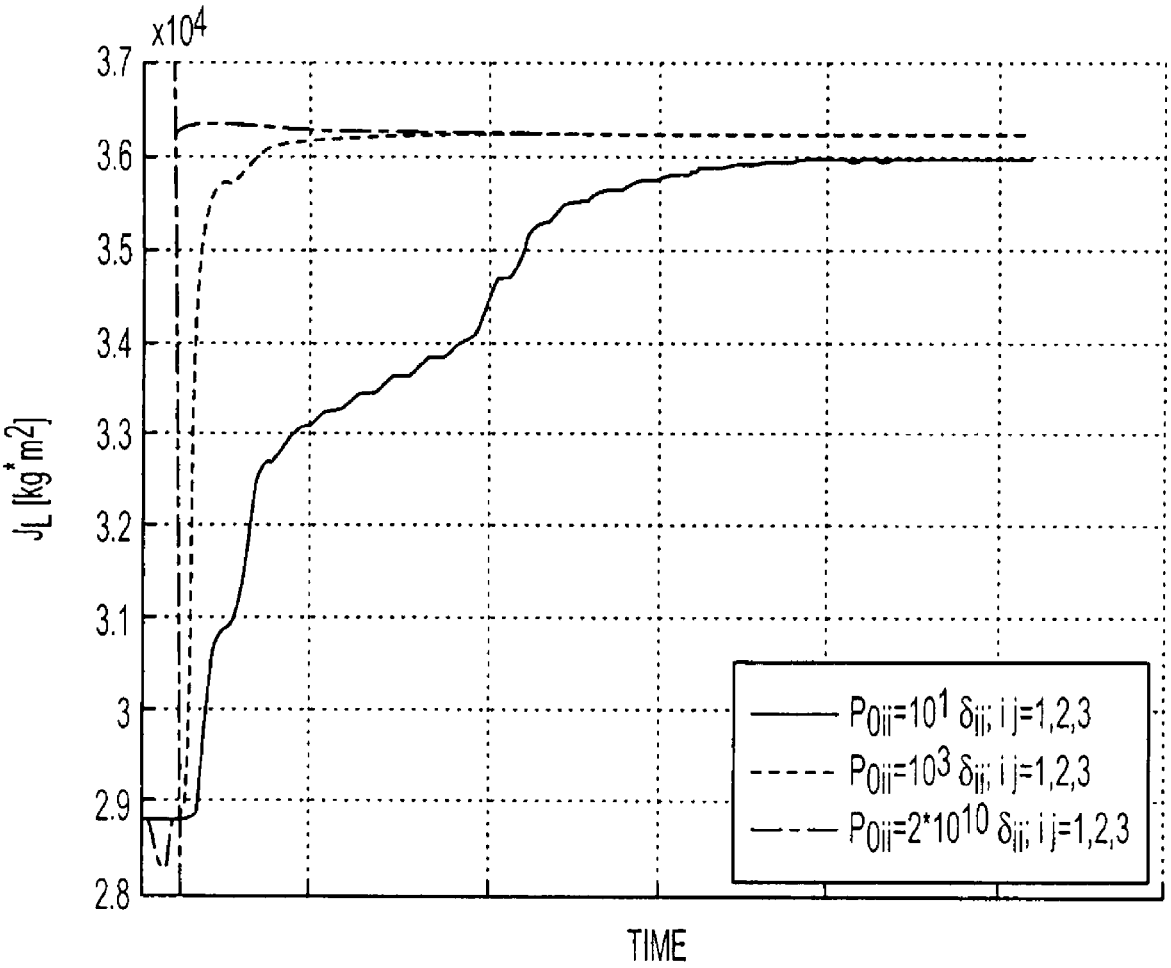
FIG. 6 shows the identification performance of the extended Kalman Filter 316 depending on the probability matrix $P_0$.

The simulation results shown in FIG. 6 are obtained by using this configuration. The three graphs represent the results obtained by using three different initial values for the covariance matrix of the estimation error. The higher the values of this matrix are the faster the estimated moment of inertia of the container reaches the reference value $J_{Lmodel}$.

The results show that even in simulation there is an upper limit for the initial value of the covariance matrix of the estimation error as the simulation model is exited by the measurement signal $\ddot{\phi}_{c_measured}$. This means the identification algorithm is very sensitive to unconsidered disturbances of the system input if the initial covariance matrix is $P_{0ij}=2\cdot10^{10}\ \delta_{ij}$; i,j=1, 2, 3 ($\delta_{ij}$ is the Kronecker delta) or greater.

Experimental Studies

Figure 3:
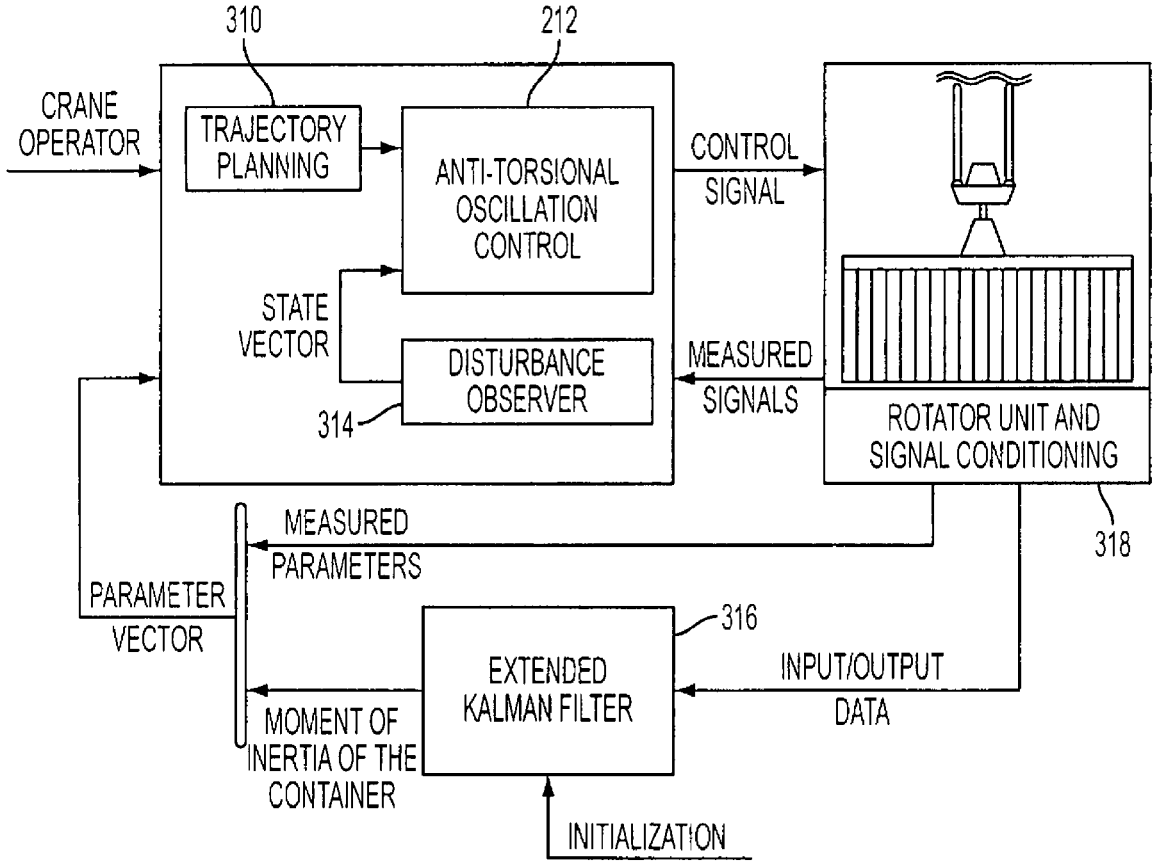
FIG. 3 shows the structure of the Anti-torsional Oscillation control.
Figure 7:
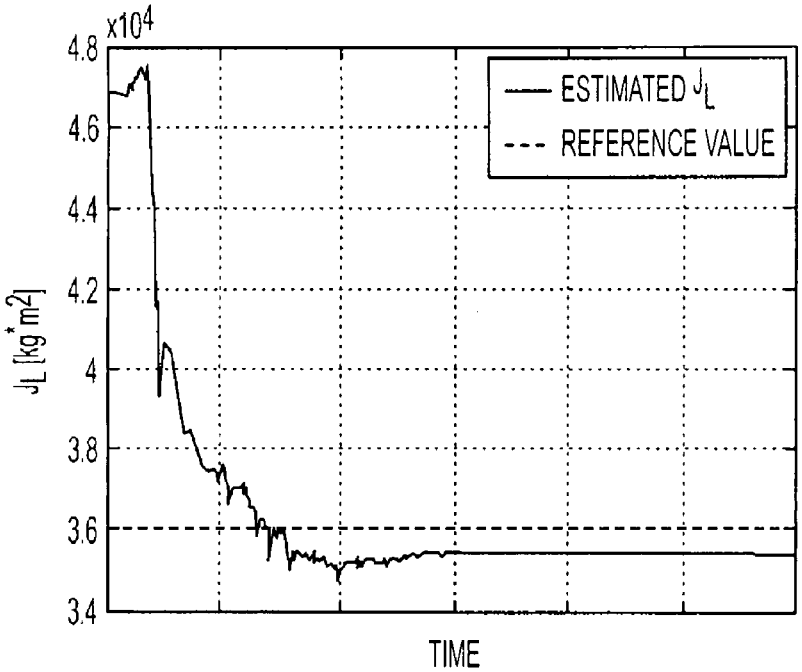
FIG. 7 shows the identification of $J_L$ with wrong initial value.

In order to evaluate the performance of the Extended Kalman Filter, the algorithm is implemented in the control and automation concept of the boom crane particularly in the adaptive anti-torsional oscillation control 212 part as presented in FIG. 3. The obtained experimental results are calculated on-line by the Extended Kalman Filter algorithm during crane operation. The experiments show that the best initial value of the covariance matrix is $P_{0ij}=7\cdot10^2\delta_{ij}$; i,j=1, 2, 3. This is much smaller than in simulation because of model uncertainties and unconsidered disturbances of the input/output signals. However, FIG. 7 shows that the estimate of the moment of inertia of the load converge to the reference value of 36000 kgm$^2$.

Figure 8:
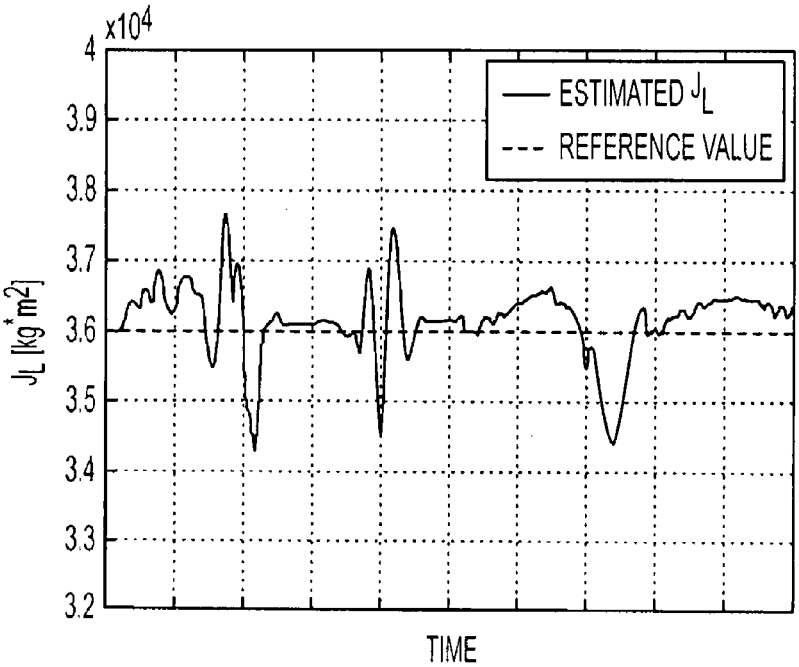
FIG. 8 shows the identification of $J_L$ with correct initial value.

The initial value for the moment of inertia $\hat{J}_{L0}$ was chosen to 47000 kgm$^2$ and the remaining parameters and initial conditions were equal to the simulation configuration. Since the excitation of the torsional movement was stopped at 150 seconds there is a residual deviation between the estimated $J_L$ and the reference value. Considering the slow dynamic behavior of the flexible system, the estimated moment of inertia rapidly converges to values in the range of tolerance around the reference value. A deviation of $\pm_5$% between $\hat{J}_L$ and the reference value of the moment of inertia has no great effect on the performance of the anti-torsional oscillation control. FIG. 8 shows the estimated moment of inertia of the load, if the initial value $\hat{J}_{L0}$ is equal to the reference value. In that case the mass of the container is evenly distributed (see equation (24)).

The obtained identification result of the parameter $J_L$ show the robustness of the Extended Kalman Filter algorithm, as no estimates are calculated outside the range of tolerance of ±5%. The small deviations between the estimated parameter and the reference value are caused by model uncertainties.

CONCLUSIONS

The present disclosure discloses an extension of a control and automation concept for the orientation of a crane load is presented. As this concept is an adaptive, model based algorithm the parameters of the dynamic model have to be known as precisely as possible. Most of the parameters can be directly measured but the moment of inertia of the crane load (container) must be identified during crane operation due to the unknown distribution of the mass. The utilized identification method, the Extended Kalman Filter algorithm, is derived based on the dynamic model of the rope suspended manipulator. This parameter identification method is integrated into the anti-torsional oscillation control and was tested on a LIEBHERR LHM 402 harbor mobile crane. The obtained measurement results illustrate the fast convergence and robustness of the estimation of the unknown moment of inertia of the crane load.

The invention claimed is:

1. A method for controlling the orientation of a crane load, wherein a manipulator for manipulating the load is connected by a rotator unit to a hook suspended on ropes, comprising:

controlling a rotational angle $\phi_L$ of the load about a vertical axis by a control unit using the moment of inertia $J_L$ of the load as a parameter, the control unit adjusting the rotator unit to rotate the manipulator relative to the hook suspended on ropes based on the moment of inertia $J_L$, where the control unit is an adaptive control unit; and identifying the moment of inertia $J_L$ of the load during operation of the crane based on data obtained by measuring a state of the system.

2. The method for controlling the orientation of a crane load according to claim 1, wherein the rotational angle $\phi_L$ of the load is controlled using an adaptive trajectory tracking control.

3. The method for controlling the orientation of a crane load according to claim 1 further comprising calculating data describing the state of the system based on a dynamic model of the system.

4. The method for controlling the orientation of a crane load according to claim 3 further comprising controlling the orientation of the crane load an anti-torsional oscillation unit using the data calculated by the dynamical model to reduce torsional oscillations.

5. The method for controlling the orientation of a crane load according to claim 3, wherein the dynamical model of the system is based on equations of motion of a physical model of at least the ropes, the hook and the load.

6. The method for controlling the orientation of a crane load according to claim 3, wherein during operation of the crane, data describing the state of the system are calculated by the dynamical model based on a value $J_{L,k-1}$ of the moment of inertia $J_L$, and a corrected value $J_{Lk}$ of the moment of inertia $J_L$ is determined based on the calculated data and the data obtained by measuring the state of the system in order to identify the moment of inertia $J_L$.

7. The method for controlling the orientation of a crane load according to claim 1 further comprising measuring movements of a cardanic element guided by the ropes to obtain data by which a rotational angle $\phi_H$ of the hook and/or the rotational angle $\phi_L$ of the load can be determined.

8. The method for controlling the orientation of a crane load according to claim 1 further comprising using a gyroscope to obtain data by which a rotational angle $\phi_H$ of the hook and/or the rotational angle $\phi_L$ of the load can be determined.

9. The method for controlling the orientation of a crane load according to claim 1 further comprising measuring a change $\dot{\phi}_H$ in a rotational angle $\phi_H$ of the hook and/or a change $\dot{\phi}_L$ in the rotational angle $\phi_L$ of the load by a gyroscope.

10. The method for controlling the orientation of a crane load according to claim 1, wherein a moment of inertia $J_H$ of the hook and $J_{Sp}$ of the manipulator are further used as parameters.

11. The method for controlling the orientation of a crane load according to claim 1 further comprising, during the operation of the crane, applying a torque to the load and/or the hook.

12. The method for controlling the orientation of a crane load according to claim 11, wherein data obtained by measuring the state of the system at least comprise a change $\dot{\phi}_H$ in a rotational angle $\phi_H$ of the hook and/or a change $\dot{\phi}_L$ in the rotational angle $\phi_L$ of the load in reaction to the torque applied to the load and/or the hook.

13. The method for controlling the orientation of a crane load according to claim 1, wherein a value of the moment of inertia $J_{L0}$ estimated only on the basis of mass and dimensions of the load is used as an initial value for $J_L$ and corrected values $J_{Lk}$ are determined in an iterative process in order to identify the moment of inertia $J_L$.

14. The method for controlling the orientation of a crane load according to claim 1, wherein the moment of inertia $J_L$ is identified using an observer.

15. The method for controlling the orientation of a crane load according to claim 1, wherein the moment of inertia $J_L$ is identified using a non-linear observer.

16. The method for controlling the orientation of a crane load according to claim 1, wherein the moment of inertia $J_L$ is identified using an extended Kalman Filter.

17. The method for controlling the orientation of a crane load according to claim 1, wherein a homogeneous distribution of mass inside the load is assumed for an estimation of an initial value $J_{L0}$ of the moment of inertia $J_L$ of the load.

18. The method for controlling the orientation of a crane load according to claim 1, wherein noise in the data obtained by measurements is taken into account in the identification of the moment of inertia $J_L$.

19. The method for controlling the orientation of a crane load according to claim 18, wherein the noise in the data obtained by measurements is modelled by covariance matrices.

20. The method for controlling the orientation of a crane load according to claim 19, wherein the covariance matrices are determined experimentally.

21. A method for controlling the orientation of a crane load, wherein a manipulator for manipulating the load is connected by a rotator unit to a hook suspended on ropes, comprising:

controlling a rotational angle $\phi_L$ of the load about a vertical axis by a control unit using the moment of inertia $J_L$ of the load as a parameter, the control unit adjusting the rotator unit to rotate the manipulator relative to the hook suspended on ropes based on the moment of inertia $J_L$, where the control unit is an adaptive control unit;

identifying the moment of inertia $J_L$ of the load during operation of the crane based on data obtained by measuring a state of the system; and varying a difference $\phi_C$ between the rotational angle $\phi_L$ of the load and a rotational angle $\phi_H$ of the hook by the rotator unit based on the identified moment of inertia $J_L$ of the load.

22. The method for controlling the orientation of a crane load according to claim 21, wherein the difference $\phi_C$ between the rotational angle $\phi_L$ of the load and the rotational angle $\phi_H$ of the hook is measured by an encoder connected to the rotator unit.

23. A system for controlling the orientation of a crane load, comprising:

a crane having a manipulator for manipulating the load;

a rotator unit coupled to the manipulator (416) through a hook suspended on ropes 410; and an adaptive control unit controlling a rotational angle $\phi_L$ of the load by adjusting the rotator unit based on a difference $\phi_C$ between the rotational angle $\phi_L$ of the load and a rotational angle $\phi_H$ of the hook by the rotator, as well as based on a moment of inertia $J_L$ of the load as a parameter, the control unit identifying the moment of inertia $J_L$ of the load about the vertical axis during operation of the crane based on data obtained by measuring a state of the system.

24. The system of claim 23 wherein the crane is a single boom crane having the ropes hanging vertically down from the boom, the load orientation controlled by the single boom crane, and where the manipulator is coupled directly to the rotator unit, the system further comprising a sensor coupled to the rotator unit, the sensor measuring the difference $\phi_C$ between the rotational angle $\phi_L$ of the load and a rotational angle $\phi_H$ of the hook.

* * * * *